United States Patent [19]

Sendzimir

[11] Patent Number: 4,512,384

[45] Date of Patent: Apr. 23, 1985

[54] CONTINUOUS SPRAY CASTING

[76] Inventor: Tadeusz Sendzimir, 269 Brookside Rd., Waterbury, Conn. 06720

[21] Appl. No.: 532,208

[22] Filed: Sep. 14, 1983

[51] Int. Cl.[3] ..... B22D 11/00

[52] U.S. Cl. ..... 164/46; 164/464; 164/479; 164/429

[58] Field of Search ..... 164/46, 463, 464, 479, 164/427, 429, 421, 422; 264/5, 8; 425/7, 8

[56] References Cited

U.S. PATENT DOCUMENTS

| | | | |
|---|---|---|---|
| 1,662,008 | 3/1928 | Legate | 164/46 X |
| 2,307,939 | 1/1943 | Merle | 164/46 X |
| 2,639,490 | 5/1953 | Brennan | 164/427 X |
| 2,762,093 | 9/1956 | Hood | 164/46 |
| 2,864,137 | 12/1958 | Brennan | 164/429 X |
| 3,670,400 | 6/1972 | Singer | 164/479 X |
| 4,114,251 | 9/1978 | Southern et al. | 164/46 X |
| 4,419,060 | 12/1983 | Speier et al. | 264/8 X |

FOREIGN PATENT DOCUMENTS

| | | | |
|---|---|---|---|
| 2528843 | 1/1976 | Fed. Rep. of Germany | 164/46 |
| 511995 | 6/1976 | U.S.S.R. | 164/46 |

*Primary Examiner*—Kuang Y. Lin

*Attorney, Agent, or Firm*—Frost & Jacobs

[57] ABSTRACT

The present invention is an improvement over, and an adaptation to continuous casting, of known processes in which a molten metal such as steel is atomized under non-oxydizing conditions and projected at high velocity against a suitable target. The distance to the target is such that the atomized particles solidify on their way and hit the target in a solid, yet still plastic, state to be welded onto said target by their kinetic energy. Applicant has found a way to adapt such process to continuous operation, and more particularly, to production of wide slabs of great length and relatively small thickness, say, typical 1.5″×60″ section and achieving that at great speeds of operation, such as 100 to 500 tons per hour which speed makes it possible to place it upstream of a continuous hot strip mill and thus produce, say, 0.060″×60″ strips in one continuous operation, from molten metal. (Such mills cannot maintain their thermal balance if the speed of the workpiece is too slow).

Another feature of the subject process is that it lends itself to an easy recuperation of the heat of fusion of the metal and of a substantial part of the heat contained in the product.

9 Claims, 6 Drawing Figures

CONTINUOUS SPRAY CASTING

BACKGROUND OF INVENTION

In the original application of applicant's U.S. Pat. No. 2,597,046 there is an embodiment disclosed in which liquid metal is poured into an atomizer rotating around a vertical axis to project the atomized particles against the innermost diameter of a thoroid which is like a long helical spring bent around to form a circle, with the two ends joined together to look like a doughnut. The convolutions of said thoroid touch each other at its horizontal plan of symmetry (which is the plane of projection of the atomized particles), and form there a cylindrical surface.

The projected particles impinge against said cylindrical target and most of them solidify on contact to form a ring. Since said thoroid is slowly rotating around its circular axis and the deposited ring follows that surface, said ring is progressing downward to form a tube.

Said embodiment has become subject of a divisional application Ser. No. 286,076 which applicant has abandoned after the first action because of operating difficulties that were discovered. The atomized particles did not lose much heat before reaching their target and moreover, the contact with the heat-absorbing thoroid was very short. Consequently the production rate was too slow for an industrial unit. Besides, there were frequent interruptions when a part of an already formed tube fell down because it was not sufficiently solidified.

Not until recently has applicant been able to find how that original embodiment can be made to work. By combining the action of a few elements, he obtained rather unexpected results that not only assure industrial production of plates and other flat products but permit to do so on a scale surpassing by far existing industrial processes. The method consists in:

1. Reshaping the atomizer to admit 3 to 4 times the quantity of gas needed for atomizing, while creating sufficient turbulence for the excess gas to absorb heat from the atomized particles so that at least half of them reach their target in a solid, though plastic, state.

2. Using a pneumatic motor to rotate the atomizer brought the speed to over 6000 r.p.m. while taking advantage of the cooling effect of the expanding gas to insure dependability of operation in close proximity of molten steel at 1600° C.

3. The centrifugal force acting on the atomized particles at such speed aided by the above mentioned current of cooling gas from the atomizer has in turn permitted to place the target a considerable distance farther from the atomizer, as much as 75 to 100 ft. diameter which gives the atomized metal a colossal area of contact with the target to absorb the remaining melting heat in the metal and even to lower its temperature somewhat.

4. By enclosing the umbrella of projected atomized particles between heat-absorbing roof and floor, to form a gas-tight chamber for the non-oxydizing gas, cooling of said particles by radiation is increased. On top of it, the atomizer itself is made to oscillate vertically by several inches or even more (always within the space between said roof and floor of the gas-tight chamber). This step also increases several times the area of the target.

5. Furthermore, applicant is providing inside and out, heat absorbing fences surrounding the product, i.e. the huge tubular body, and thus, as an extra effect, has created means for an almost total recuperation of the heat of the molten metal by means which are accessible, easy to use and to maintain.

By fairly accurate calculation such continuous spray caster built to produce a 75 ft. diameter tube has ample capacity to produce 500 tons per hour which is about 3,000,000 tons a year. This is enough for many steel works to constitute the only caster for the general mix of flat products, from plates and tubes, through autobody and other sheets down to tinplates. The cost of such unit is high, but is considerably less than two or three conventional units that could jointly achieve the same tonnage.

Such products possess a homogeneous, small-grained, almost non-porous metal structure which is characteristic of spray casting and are completely free of segregations that are unavoidable with conventional continuous casting.

When passing molten steel through an atomizer, certain alloying elements such as Ni, Mo, Va may be added to alloy with the steel. Measured quantities of such metals in powder form are injected together with the steel. If the percentage of the alloying elements is high, the steel should be sufficiently superheated.

For steel qualities requiring a steel of less exacting analysis, such as rebars, the subject process permits to eliminate the steel-making operation altogether, resulting in substantial reduction of costs.

Pig iron from the blast furnace, after removal of sulphur and silicon, is passed through the atomizer together with measured quantities of iron-oxide which may be mill scale or refined iron ore which is reduced to iron after the particles have reached their target, by combining with the carbon of which the pig iron may have 3 to 5%. The quantity of the iron oxide which is added must be calculated to leave some excess carbon to produce steel with the carbon content required.

BRIEF DESCRIPTION OF THE DRAWINGS

Following figures will facilitate understanding of the present invention.

DESCRIPTION OF PREFERRED EMBODIMENTS

Figure 2:
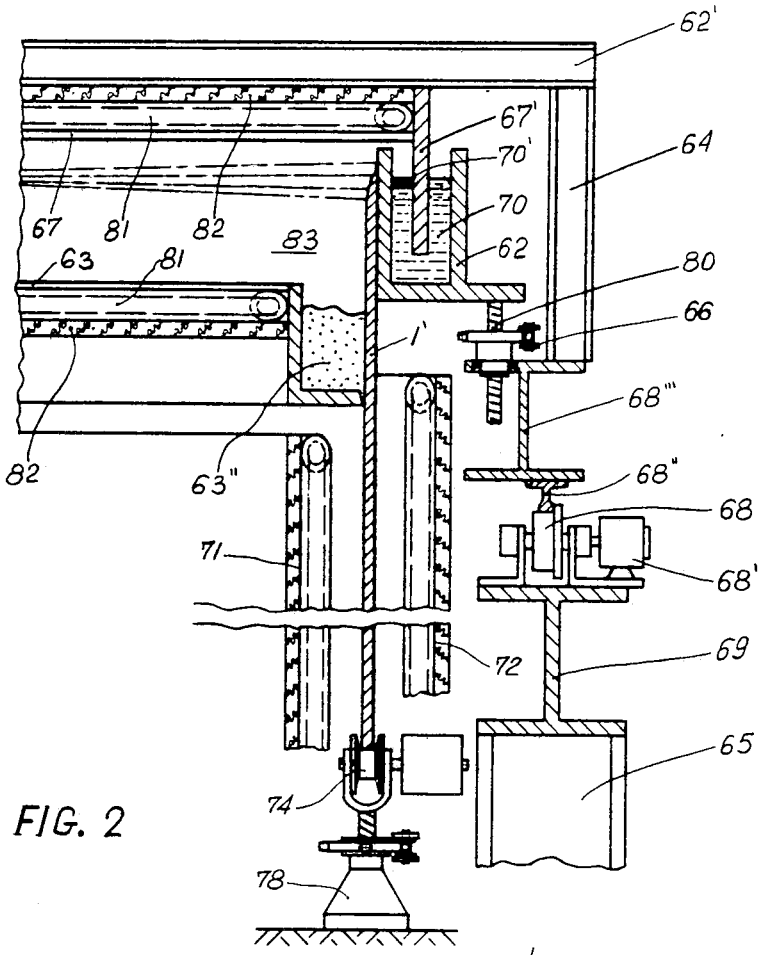
FIG. 2 is a cross section of a detail thereof.
Figure 1:
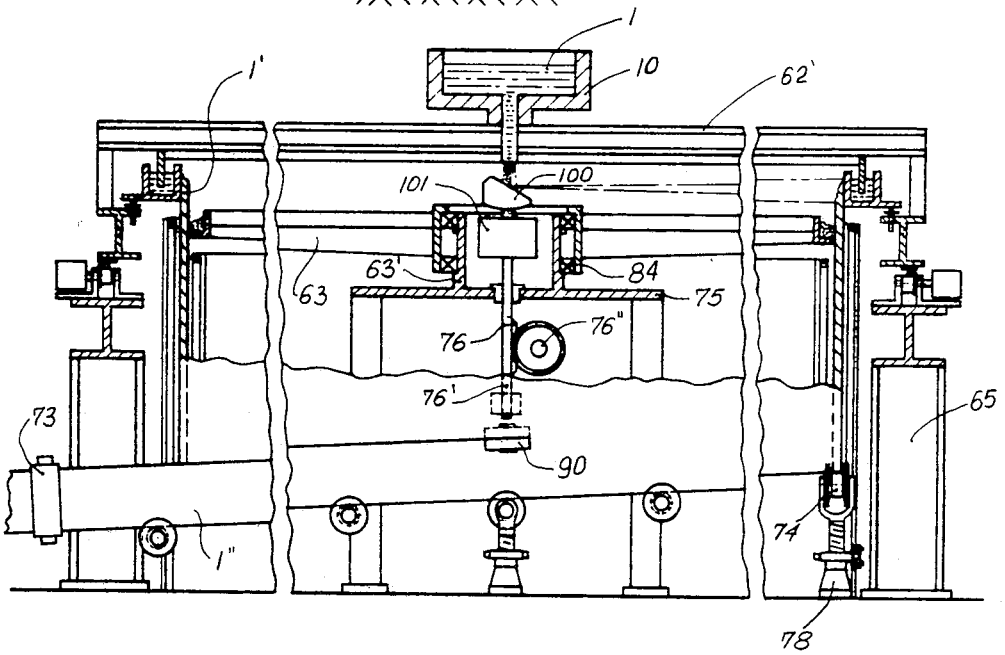
FIG. 1 is a vertical section and partial view of a preferred embodiment of the invention.

The complete apparatus for producing by spray-casting a huge diameter tube and simultaneously shearing it along a helical line at its bottom end to produce a strip or plate of great length is shown in side view and partial section in FIG. 1 and, in addition, the main structure and the details of the target area are shown in cross section in FIG. 2.

A circle of columns 65 coaxial with the atomizer 100 whose tops are joined by horizontal beams 69 with a circle of wheels 68, with their motors 68' mounted on top of them and supporting the circular rail 68'' attached to the bottom of circular beam 68''' which forms the base of a rotary stage, concentric with said atomizer, which includes the U-section target 62 against the inner diameter of which said atomizer projects the molten steel particles to start formation of the tube 1' and continue to build it up to full wall thickness.

It further includes means for oscillating said U-section target 62, always by a few inches, first quickly up, then down, at the velocity of the tube 1' that is being formed, exactly as is the current practice of reciprocating the crystallizing mould of conventional slab casting equipment. It consists of a circle of ball screw jacks 80 located in the upper flange of said beam 68''', their nuts formed as hubs of chain sprockets, all of which engaging on a chain 66. Said chain in turn is actuated by a hydraulic cylinder (not shown) attached to it at a point between any two of said jacks.

Said circular beam 68''' further supports a beam structure 62' supported by columns 64 to which is attached a circular closure or roof 67 of the gas-tight chamber 83 that assures said atomized particles protection from oxydation on their trip towards the target. Since said U-section target 62 is partly filled with water 70 for cooling, a cylindrical roof lip 67' attached to said roof 67 dips into said U-section target so as to seal it. A thin layer of oil 70' or other suitable substance is left floating on top of said water inside lip 67' to prevent evaporation.

Recuperation of the heat of solidification of said molten particles is easily assured by lining said roof 67 (as well as a floor 63) with closely spaced boiler tubes 81 through which water and/or steam is circulated. Said tubes 81 in turn are protected against heat losses by a layer of a heat insulator 82 on the outside.

The floor 63 of said gas-tight chamber 83 is rotatably supported by a big ball bearing 84 located on tube 63' of the central structure 75 supporting the atomizer 100. It is sealed gas-tight against the inner face of the tube 1' being produced, by the sand seal 63'' whose friction against said tube causes it to rotate.

The heat from tube 1' is recuperated by fences 71 and 72 of heat absorbing tubes backed by insulating material.

Atomizer 100 with its air motor 101 are attached to the stem 76 which is slidably located in the central structure 75. Stem 76 has a rack 76' attached to it and actuated by motorized pinion 76'' to impart an up and down oscillation to said atomizer 100 whereby to increase the targeted area and therefore also the rate of production of the whole facility, as much as desired, within the limits set by the height of the U-section target 62.

The product is progressing downwards while being slowly rotated and has a form of a big diameter tube 1' whose wall thickness may be as thick as 2 inches but a perfect product can also be achieved with thinner walls, even as thin as $\frac{3}{8}$ inch. In order to convert it into slabs it must be sheared along a helical line whose pitch determines the width of the strip, plate or slab according to the thickness selected. Rotary shear 90 does the cutting and strip 1'' is deflected tangentially and pulled by pinch rolls 73 for cutting into desired length of coiling.

The thus exposed helical bottom edge of the tube 1' is supported over the whole circumference by a plurality of grooved rollers 74 mounted in suitable height-adjustable supports 78.

Said adjustability, in proportion, for each roller, to its position around the periphery of the tube (0° to 360°) is required for controlling the angle of the helix according to the width of the slab that is required. 18 such motorized rollers disposed one every 20° around the circumference of the tube 1' support and rotate it. They are mounted in screw jacks whose pitch increases proportionally to the angle around the periphery. Thus the angle of the helical line along which the tube is sheared can be altered by turning the nuts of all 18 screw jacks by the same angle. Changing the width of the strip is thus very simple.

Figure 3:
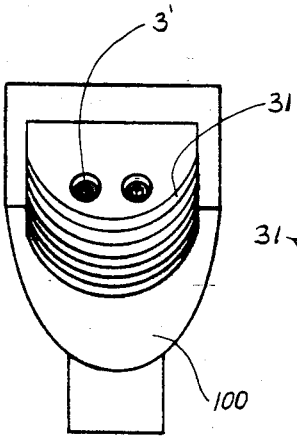
FIGS. 3 and 4 are front and cross section views of a molten metal atomizer employed.
Figure 4:
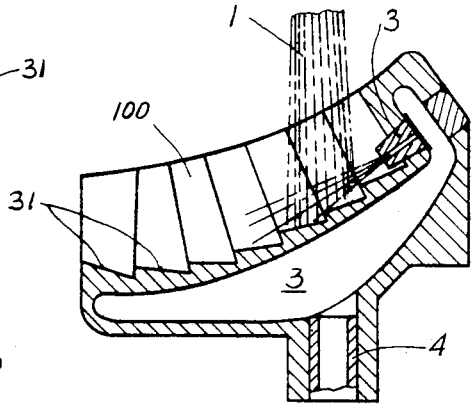

FIGS. 3 and 4 represent, in front view and longitudinal section, respectively, the high-speed rotary atomizer head 100 (also shown on FIG. 1) for molten steel. The sawtooth-section spoon-form internal cavity 31 is very deep. This is needed to impart to the particles the tremendous acceleration by centrifugal force permitting them to reach their target in about the order of 1/10th of a second. High pressure non-oxydizing gas, in excess quantity over and above the needs of atomization, is admitted through hollow shaft of the motor 4, first, into chamber 3, to cool said spoon-form cavity which it finally enters through at least two downward inclined nozzles 3' where said gas rushes in form of a turbulent flat stream sweeping past the teeth of the cavity (increasing the turbulance) with such force that the stream of molten metal steel 1 descending vertically from tundish 10 (shown on FIG. 1) is first declined and never touches said teeth 31, to be finely atomized by said turbulent stream of gas and projected by it, jointly with the centrifugal force created by the fast rotation of said head, almost horizontally towards the ring-form target in whose axis it rotates.

Said toothed interior 31 is ceramic-coated to prevent accidental sticking to it of metal droplets. The atomizer head 100 projects the atomized metal at a high velocity against the non-sticking, heat-absorbing target, while causing it to lose heat underway, so that at least half of the particles are solid, though still plastic, when hitting the target. The atomizer head causes the stream of projected particles to be swept rapidly across the target, so as to deposit upon it a layer substantially only one particle deep at each passage, so as to cause even those particles that may have reached the target while still in molten state, to reach a crystallizing stage before the next passage of the stream.

Figure 5:
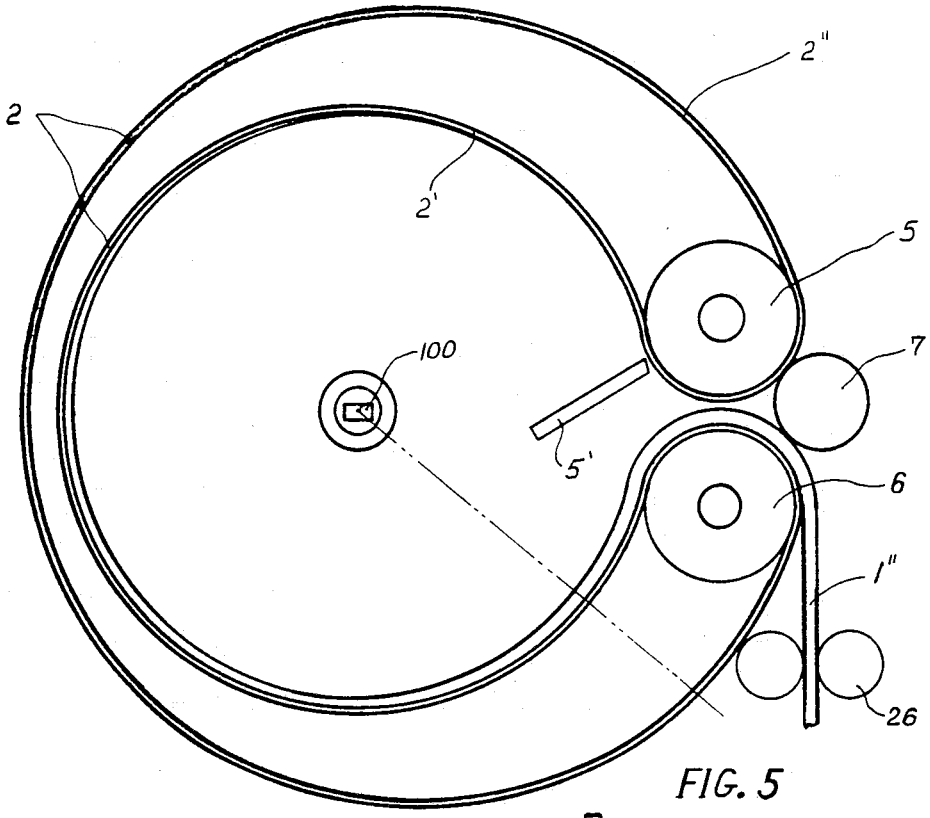
FIG. 5 is a schematic top view of another embodiment of the invention.
Figure 6:
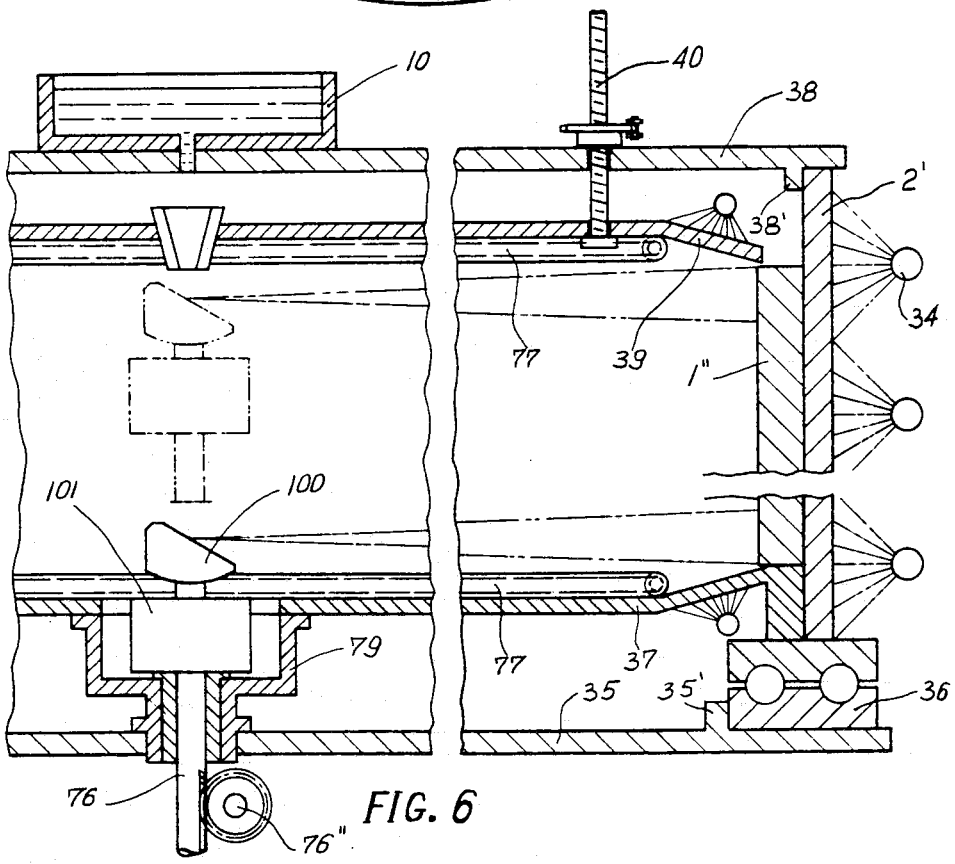
FIG. 6 is a cross section of a detail thereof.

FIGS. 5 & 6 show a simplified embodiment where a central atomizer 100 is also employed but where the distribution of the atomized particles over the whole width of the plate being produced relies solely upon the vertical oscillation up and down of said atomizer. The cylindrical target is formed by a heavy-gauge endless metallic belt conveyor 2. 2' FIG. 5) is the portion of said belt, forming the cylindrical target. On its return trip over the tangential exit pulley 6 said belt describes any suitable path such as the circle 2'' and then, over the pulley 5, it joins the target cylinder 2'. This target belt is slightly wider than the maximum plate width, say, $6\frac{1}{2}$ ft for a 6 ft wide plate.

For guiding the belt in the target area, its bottom edge is supported by the upper race of a ball bearing track-race 36 which is concentric with said target and it is maintained by tension in contact with the concentric circular collar 37 provided upon said race. A loose circular cover 38 similarly guides the upper edge of said belt 2'. Cover 38 also holds the gas-tight roof 39 of the atomizing chamber, which is hung from it on height-adjustable jacks 40 for controlling the width of the product 1''. A similar ball bearing track is provided to guide the belt on its outside return trip. The gas-tight bottom plate 37 of said chamber is not adjustable for height. The outer edge portions of both plates are at a slight angle to horizontal so as to deflect any atomized particles that may hit them, back upon the target. Both plates 37 and 39 are also provided with heat-absorbing means, such as boiler tubes 77 through which steam or water is circulated.

The atomizer 100 with its air motor 101 is affixed to the top end of stem 76 which is slidably located in bearings provided in the structure 79 in the axis of the instrumentality. Pneumatic actuator 76'' located in the same structure 79 is provided to oscillate said atomizer up and down over a rack and pinion or equivalent gearing.

Atomizer 100 is shown in its lowest position and in dotted lines, in the highest.

As explained above, the oscillations are rapid so as to deposit only a very thin layer of projected particles at each passage and the velocity is automatically controlled to correct any differences in thickness of the plate across its width. Thickness differences lengthwise of the plate are corrected by controlling the speed of pinch rolls 26 that extract the plate, because the thickness of the plate increases gradually as it is being built-up upon the target-belt 2' from the entry pulley 5 to the exit pulley 6.

A ceramically coated deflector plate 5' is provided opposite the spot where the two pulleys meet to prevent any projected particles from being thrown between the pulleys.

The outside surface of the inner cylinder target-belt 2' is cooled by closely spaced sprays 34 but the thickness of the belt itself must be substantial so as to avoid local overheating, say $\frac{3}{8}$ to $\frac{1}{2}$ inch. When steel belts are used and prove to be short-lived owing to the rapid temperature changes, a much longer endless belt may be provided and the belt deviated from the outer cylinder 2'' and into a double spiral coil accumulator (such as disclosed in U.S. Pat. No. 3,310,255) and back again to close the belt. This permits to avoid frequent belt changes.

The outgoing pulley 6 is preferably driven, since it reverse-bends the produced plate and this requires most of the energy consumed, especially when the plate is heavy. Loose roll 7 pressed against the exiting plate on the exit pulley and the endless belt on the entry pulley also serves the purpose of producing a gas-tight seal.

I claim:

1. A method of continuously producing a single metallic strip product of unlimited length from molten steel comprising the steps of providing a heat absorbing target having a cylindrical target surface with a vertical axis, locating means axially of said target surface for projecting a stream of molten particles against said target surface, providing a heat absorbing upper horizontal plane above said projecting means and a heat absorbing lower horizontal plane below said projecting means, said upper and lower planes cooperating with said target surface to form a chamber, maintaining a non-oxidizing atmosphere within said chamber, rapidly rotating and vertically oscillating said projecting means and said stream of molten particles produced thereby to deposit on said target surface a layer of metallic particles substantially only one particle deep to assure that all the particles of said layer reach a crystalizing stage before the deposition of another layer thereon, similarly depositing subsequent layers until the product of required thickness is produced, providing said target surface with a diameter such that at least half of said particles are solid and plastic when they hit said target surface, rotating said target and said product formed thereon, and withdrawing said metallic product as a single strip.

2. The method claimed in claim 1 including the step of providing said projecting means in the form of an atomizing head rotatable about said axis of said target surface, feeding molten metal to said head axially from above said head, providing said head with a spoon-shaped surface deep enough for effective acceleration of atomized particles of said molten metal by centrifugal force, providing said spoon-shaped surface with a plurality of sawtooth-section teeth extending transversely thereof and a hollow chamber therebeneath, providing a non-oxidizing gas, under pressure and in excess quantity over that needed for atomization of said molten metal, to said chamber to cool said spoon-shaped toothed surface and directing said gas from said chamber through at least two nozzles at one end of said spoon-shaped surface and along said teeth to increase turbulance of said gas from said nozzle and to assure atomization of said molten metal and deflection thereof to prevent contact of said molten metal with said teeth, and rotating said atomizer head such that said turbulent gas flow and centrifugal force direct said atomized metal substantially horizontally toward said target surface.

3. The method claim in claim 1 wherein said heat absorbing target comprises an annular member providing a vertical cylindrical target surface and including the steps of depositing said layers on said target in the form of a product tube, vertically oscillating said target so that said product tube continuously shifts downwardly from said target surface and below said lower plane, supporting the lower edge of said product tube while slowly rotating it and cutting said product tube along a helical line to produce said product strip.

4. The method claimed in claim 1 wherein said target comprises an endless belt conveyor, and including the steps of constantly rotating said belt conveyor about closely spaced entrance and exit pulleys, guiding a first flight of said belt conveyor between said entrance and exit pulleys in a cylindrical path of travel so as to form said vertical target surface, guiding the remainder of said belt conveyor in a second flight exteriorly of said first flight from said exit pulley to said entrance pulley, forming said strip product on said first flight between said upper and lower planes by said rotating and oscillating projecting means, and removing said product strip from said first flight of said belt conveyor near said exit pulley.

5. The method claimed in claim 3 including the step of providing said projecting means in the form of an atomizing head rotatable about said axis of said target surface, feeding molten metal to said head axially from above said head, providing said head with a spoon-shaped surface deep enough for effective acceleration of atomized particles of said molten metal by centrifugal force, providing said spoon-shaped surface with a plurality of sawtooth-section teeth extending transversely thereof and a hollow chamber therebeneath, providing a non-oxidizing gas, under pressure and in excess quantity over that needed for atomization of said molten metal, to said chamber to cool said spoon-shaped toothed surface and directing said gas from said chamber through at least two nozzles at one end of said spoon-shaped surface and along said teeth to increase turbulance of said gas from said nozzle and to assure atomization of said molten metal and deflection thereof to prevent contact of said molten metal with said teeth, and rotating said atomizer head such that said turbulent gas flow and centrifugal force direct said atomized metal substantially horizontally toward said target surface.

6. The method claim in claim 3 including the step of adjusting the pitch of said helical cutting line to determine the width of said product strip.

7. The method claimed in claim 3 including the step of providing concentric heat absorbing fences adjacent the inside and outside surfaces of said product tube below said lower plane to recuperate heat therefrom predominantly by radiation.

8. The method claimed in claim 4 including the step of providing said projecting means in the form of an atomizing head rotatable about said axis of said target surface, feeding molten metal to said head axially from above said head, providing said head with a spoon-shaped surface deep enough for effective acceleration of atomized particles of said molten metal by centrifugal force, providing said spoon-shaped surface with a plurality of sawtooth-section teeth extending transversely thereof and a hollow chamber therebeneath, providing a non-oxidizing gas, under pressure and in excess quantity over that needed for atomization of said molten metal, to said chamber to cool said spoon-shaped toothed surface and directing said gas from said chamber through at least two nozzles at one end of said spoon-shaped surface and along said teeth to increase turbulance of said gas from said nozzle and to assure atomization of said molten metal and deflection thereof to prevent contact of said molten metal with said teeth, and rotating said atomizer head such that said turbulent gas flow and centrifugal force direct said atomized metal substantially horizontally toward said target surface.

9. The method claimed in claim 4 including the steps of adjusting the vertical position of said upper horizontal plane and the oscillating of said projecting means to determine the width of said product strip.

* * * * *